US011678773B2

(12) United States Patent
Robertson

(10) Patent No.: US 11,678,773 B2
(45) Date of Patent: Jun. 20, 2023

(54) FOLDING SHOWER SEAT

(71) Applicant: Elcoma Metal Fabricating and Sales, Inc., Canton, OH (US)

(72) Inventor: Charles Robertson, Canton, OH (US)

(73) Assignee: Elcoma Metal Fabricating and Sales, Inc., Canton, OH (US)

( * ) Notice: Subject to any disclaimer, the term of this patent is extended or adjusted under 35 U.S.C. 154(b) by 0 days.

(21) Appl. No.: 17/549,999

(22) Filed: Dec. 14, 2021

(65) Prior Publication Data

US 2022/0192432 A1 Jun. 23, 2022

Related U.S. Application Data

(60) Provisional application No. 63/127,404, filed on Dec. 18, 2020.

(51) Int. Cl.
*A47K 3/28* (2006.01)

(52) U.S. Cl.
CPC ..... *A47K 3/282* (2013.01)

(58) Field of Classification Search
CPC ..... A47K 3/282; A47K 3/122; A47K 9/06
USPC ..... 4/611
See application file for complete search history.

(56) References Cited

U.S. PATENT DOCUMENTS

| | | | | |
|---|---|---|---|---|
| 4,087,127 | A | 5/1978 | Lotta | |
| 6,807,690 | B1 | 10/2004 | Satterfield | |
| 8,550,546 | B2 * | 10/2013 | Breit | A47C 4/20 297/14 |
| 9,844,272 | B1 | 12/2017 | Vetter et al. | |
| 10,463,158 | B2 * | 11/2019 | Lin | A47C 9/06 |
| 2015/0320222 | A1 * | 11/2015 | Windsor, IV | A47C 7/56 297/332 |
| 2016/0286961 | A1 * | 10/2016 | Windsor | A47C 1/121 |

* cited by examiner

*Primary Examiner* — Huyen D Le
(74) *Attorney, Agent, or Firm* — The Webb Law Firm

(57) ABSTRACT

A shower seat includes a frame having a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg. The first and second wall mounts are configured to secure the frame to a wall. The first and second side supports are rotatable relative to the first and second wall mounts and the rear support. A seat is secured to the frame, with the frame configured to move the seat between a use position and a stowed position.

14 Claims, 11 Drawing Sheets

FOLDING SHOWER SEAT

CROSS-REFERENCE TO RELATED APPLICATION

This application claims priority to U.S. Provisional Application No. 63/127,404, filed Dec. 18, 2020, which is hereby incorporated by reference in its entirety.

BACKGROUND OF THE INVENTION

Field of the Invention

The present invention relates to a folding shower seat.

Description of Related Art

Shower seats are used within a shower to allow persons to sit while using the shower. Shower seats may be freestanding, integral to the shower installation, or wall mounted. Wall-mounted shower seats may be moveable between a raised position when the seat is not in use and a lowered position when the seat is being used. To aid in the movement of the seat between the lowered position and the raised position, the shower seat may include an assist device that provides a biasing force to assist in movement of the seat to the raised position.

SUMMARY OF THE INVENTION

According to one aspect or embodiment, a shower seat includes a frame having a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg, with the first and second wall mounts configured to secure the frame to a wall, and the first and second side supports are rotatable relative to the first and second wall mounts and the rear support. A seat is secured to the frame, the frame configured to move the seat between a use position and a stowed position.

A biasing arrangement may be configured to provide a biasing force to aid in movement of the seat from the use position to the stowed position. The biasing arrangement may be a torsion spring. A first end of the torsion spring may be received by the first side support and a second end of the torsion spring may be received by the first wall mount.

The biasing arrangement may be a gas strut. A first end of the gas strut may be secured to rear support and a second end of the gas strut may be secured to a strut support extending between the first and second side supports.

A center support may extend between the first and second rear legs and the first and second front legs, with the center support rotatable relative to the first and second rear legs and the first and second front legs. The center support may be wishbone shaped, with an apex of the center support secured to a front leg support extending between the first and second front legs, a first end of the center support secured to the first rear leg, and a second end of the center support secured to the second rear leg. A front support may extend between the first and second side supports, with the first and second front legs connected to and rotatable relative to the front support. The seat may be secured to the first and second side supports of the frame. The first side support and the second side support may be secured to the rear support via a shaft extending through and rotatable relative to the rear support. The first and second wall mounts may each comprise a curved portion and a flange, with the flange defining a plurality of openings. The first and second rear legs and the first and second front legs may each include a height-adjustable foot.

When the seat is in the use position, a bottom surface of the seat may be perpendicular to the first and second rear legs and the first and second front legs, and, when the seat is in the stowed position, the bottom surface of the seat may be parallel to the first and second rear legs and the first and second front legs. The rear support may be formed integrally with at least a portion of the wall mounts and the first and second rear legs.

DETAILED DESCRIPTION OF THE INVENTION

Figure 1:
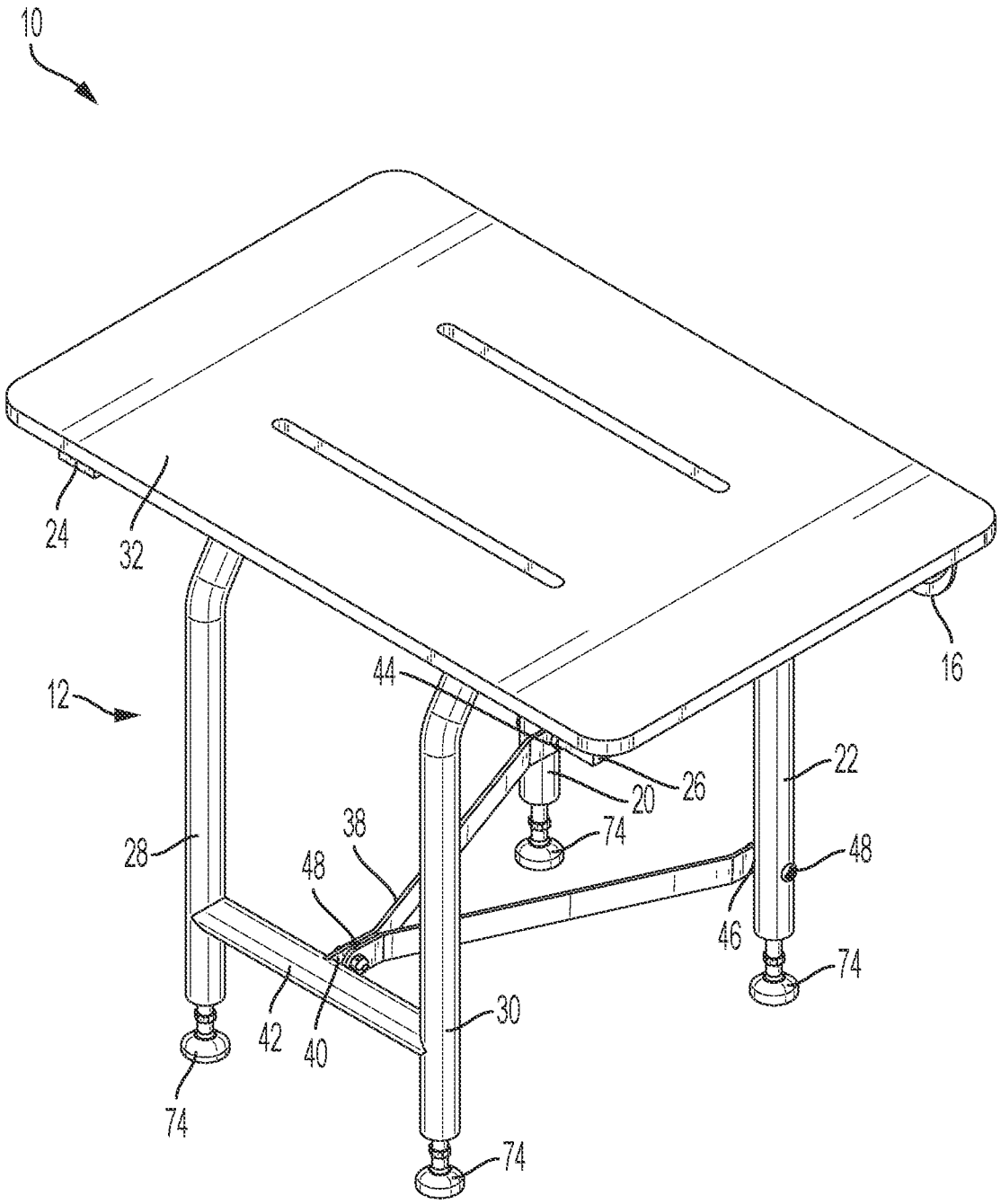
FIG. 1 is a perspective view of a shower seat according to one aspect or embodiment of the present application.
Figure 2:
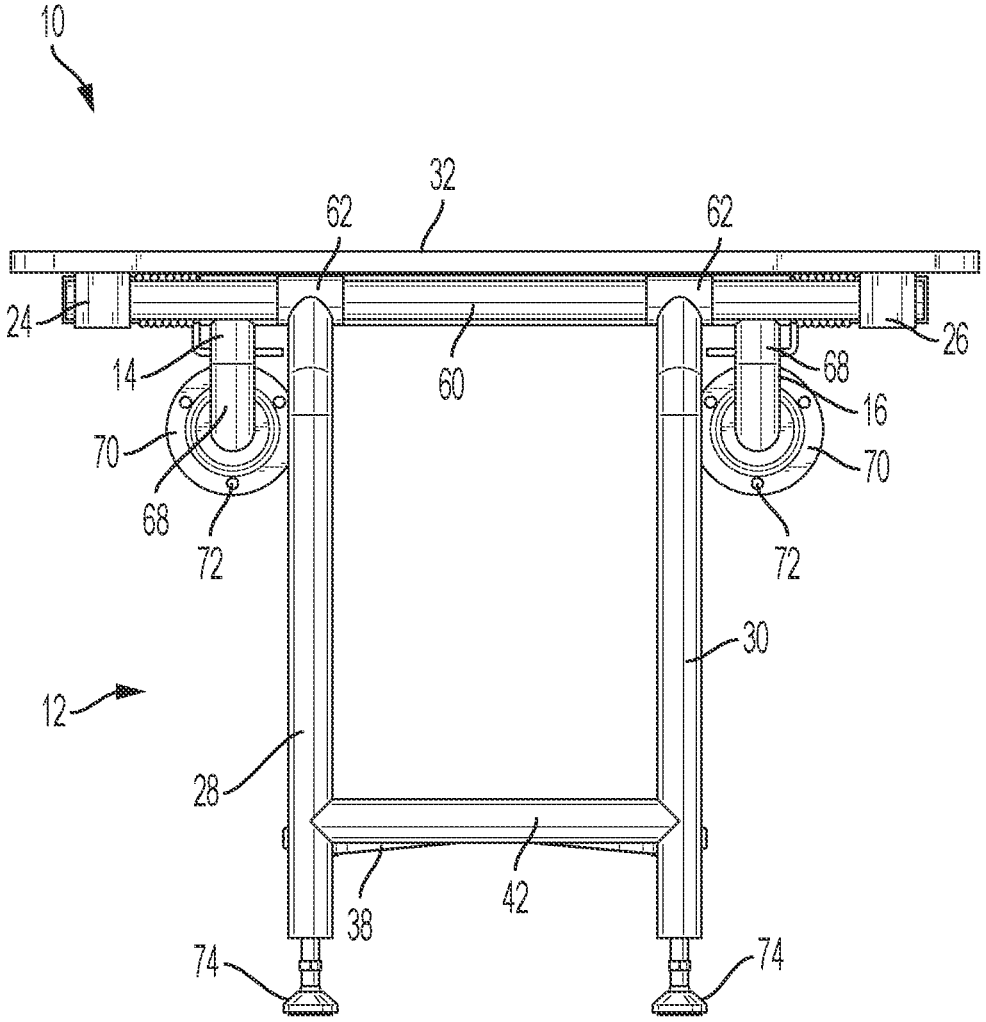
FIG. 2 is a front view of the shower seat of FIG. 1.
Figure 3:
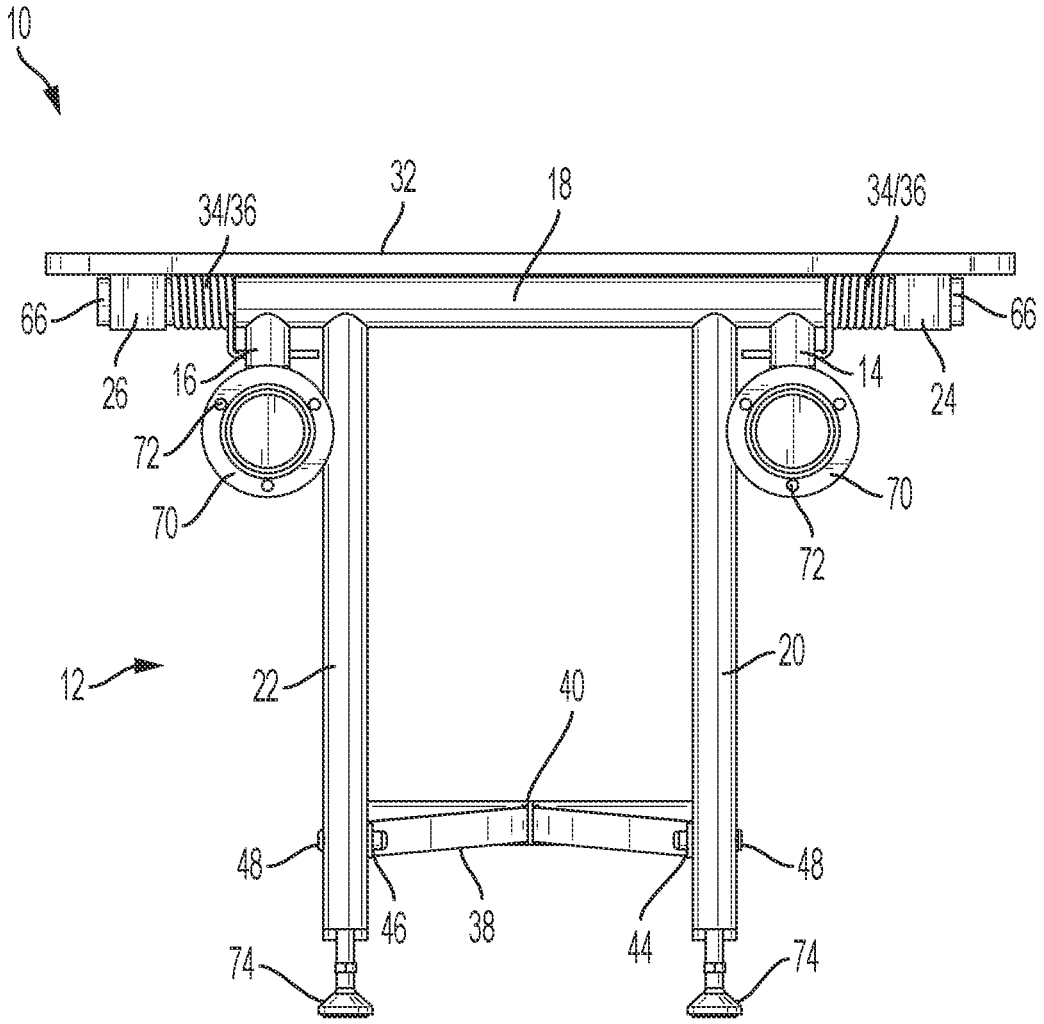
FIG. 3 is a rear view of the shower seat of FIG. 1.
Figure 4:
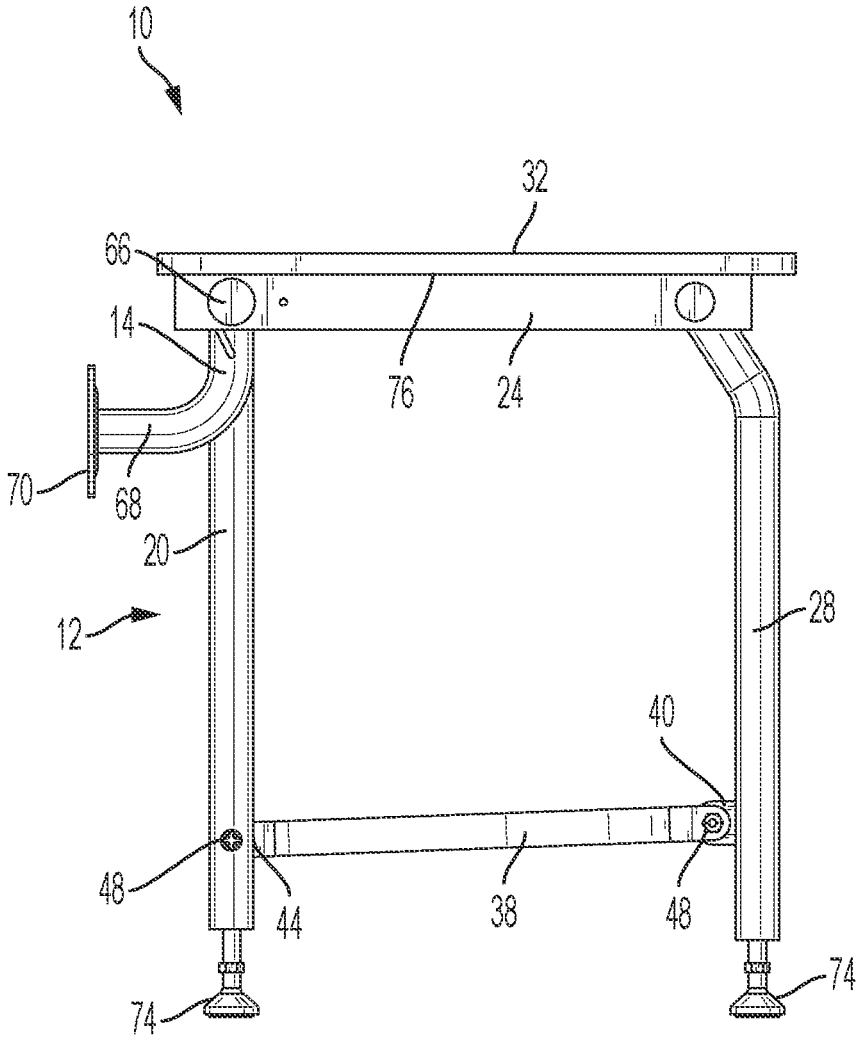
FIG. 4 is a right view of the shower seat of FIG. 1.
Figure 5:
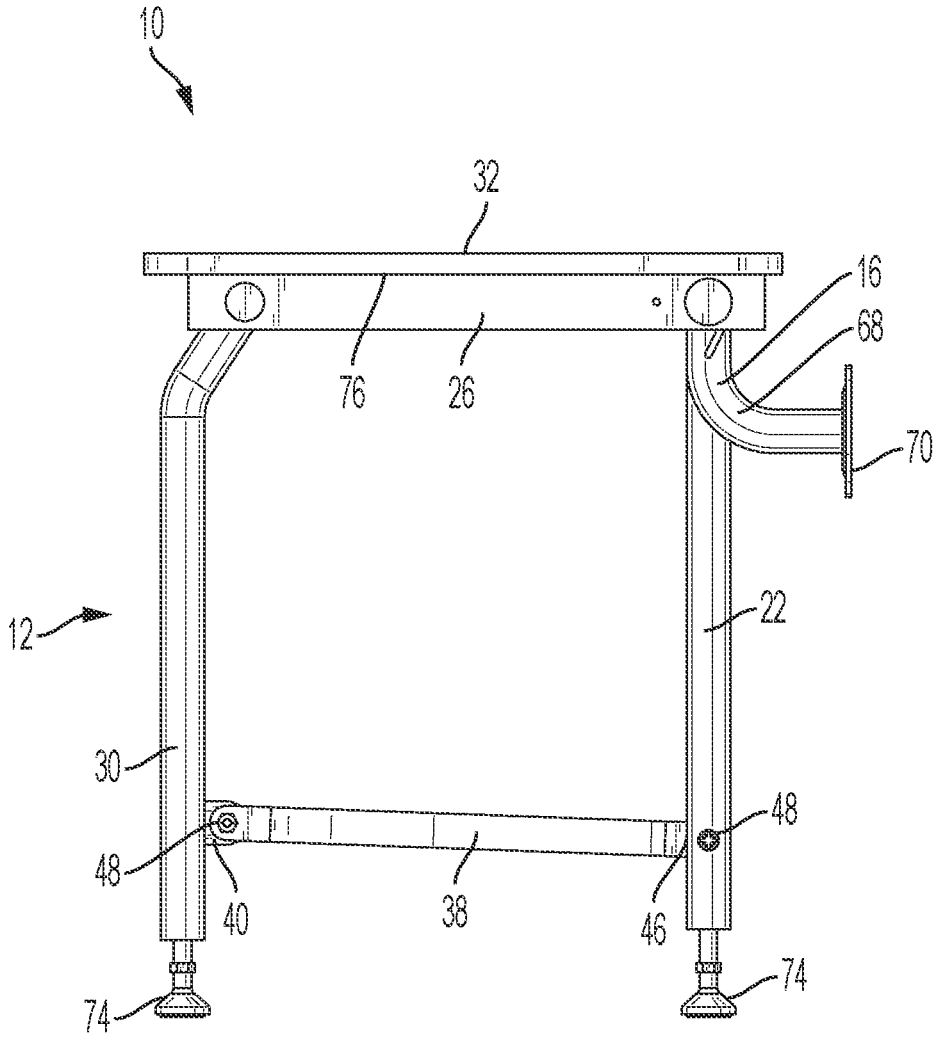
FIG. 5 is a left view of the shower seat of FIG. 1.
Figure 6:
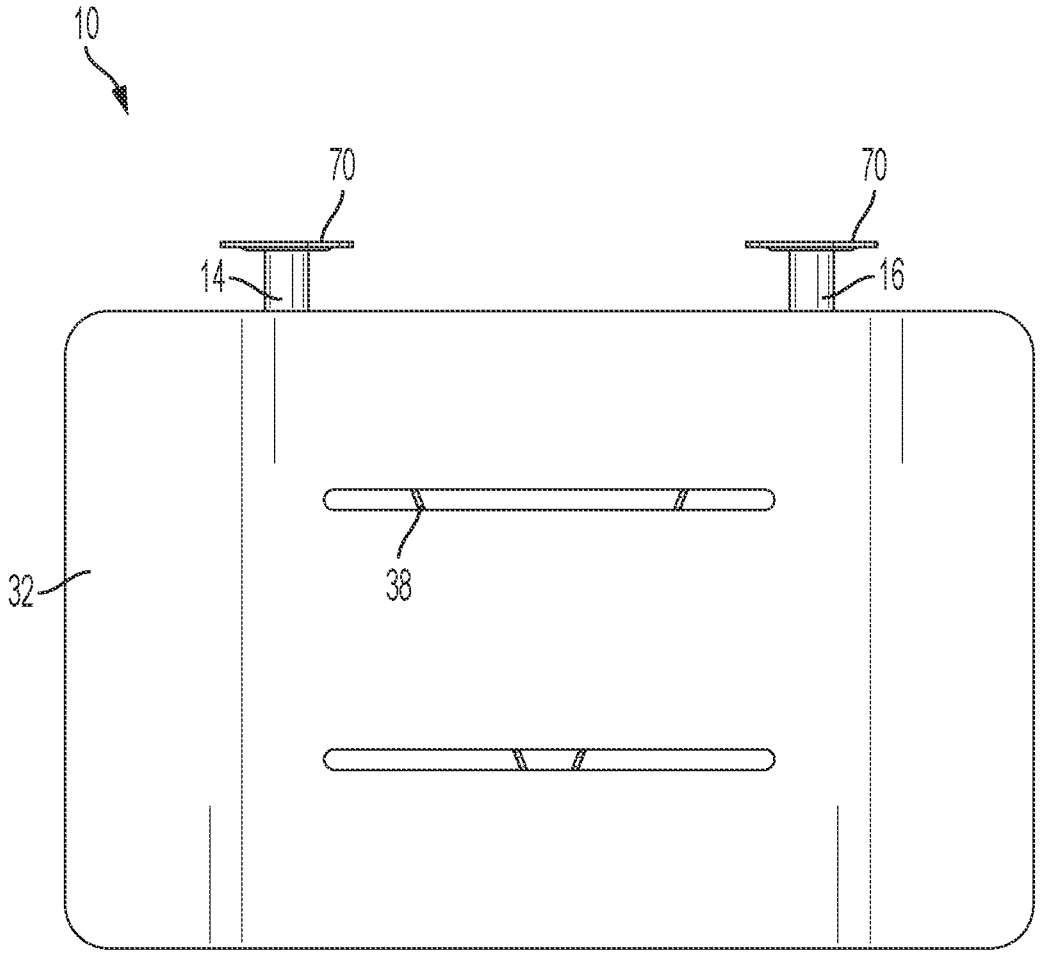
FIG. 6 is a top view of the shower seat of FIG. 1.
Figure 7:
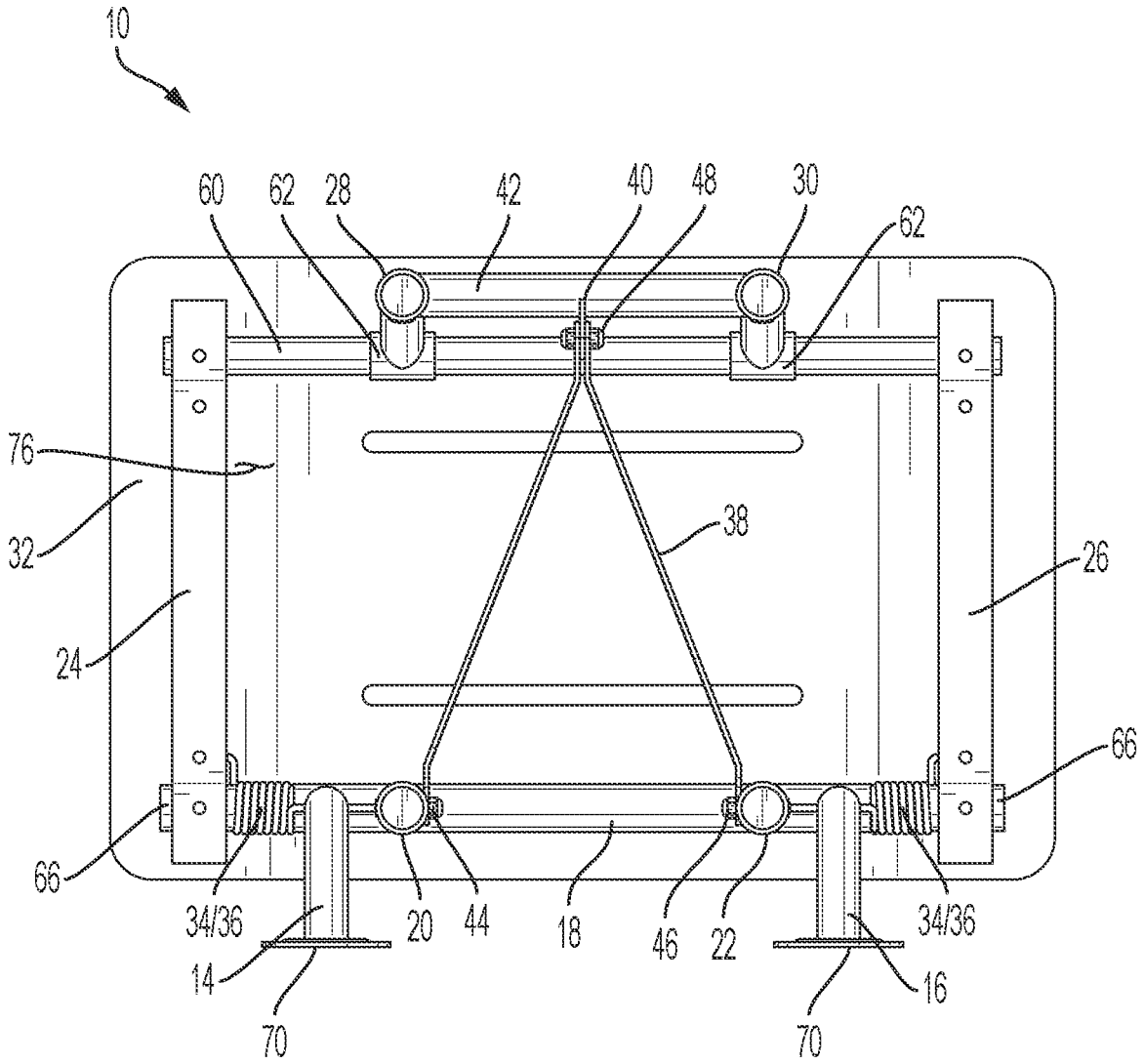
FIG. 7 is a bottom view of the shower seat of FIG. 1.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting. All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Figure 8:
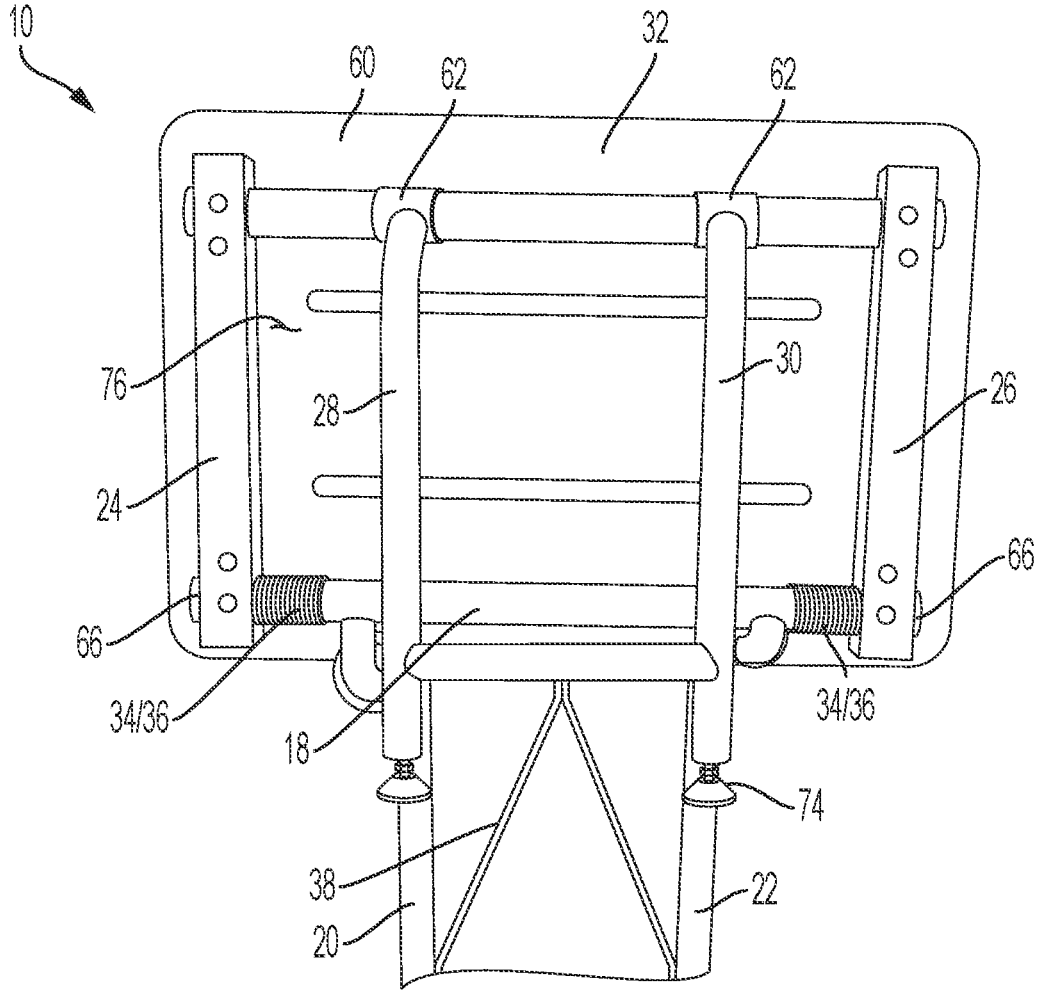
FIG. 8 is a front view of the shower seat of FIG. 1, showing a stowed position of the shower seat.

Referring to FIGS. 1-8, according to one aspect or embodiment of the present application, a shower seat 10 includes a frame 12 having a first wall mount 14, a second wall mount 16 spaced from the first wall mount 14, a rear support 18 secured to and extending between the first and second wall mounts 14, 16, a first rear leg 20, a second rear leg 22 spaced from the first rear leg 20, a first side support 24, a second side support 26 spaced from the first side support 24, a first front leg 28, and a second front leg 30 spaced from the first front leg 28. The first and second wall mounts 14, 16 are configured to secure the frame 12 to a wall. The first and second side supports 24, 26 are rotatable relative to the first and second wall mounts 14, 16 and the rear support 18. A seat 32 is secured to the frame 12, with the frame 12 configured to move the seat 32 between a use position (FIG. 2) and a stowed position (FIG. 8).

Referring again to FIGS. 1-8, the rear support 18 is formed integrally with at least a portion of the wall mounts 14, 16 and the first and second rear legs 20, 22, although the rear support 18 may be formed separately and secured to the wall mounts 14, 16 and/or the first and second rear legs 20, 22 to prevent any relative movement between those components. The shower seat 10 further includes a biasing arrangement 34 configured to provide a biasing force to aid in movement of the seat 32 from the use position to the stowed position. In one aspect or embodiment, the biasing arrangement 34 is configured such that 5 pounds or less of force is required to move the seat 32 from the use position to the stowed position. The biasing arrangement 34 is a torsion spring 36, although other suitable biasing arrangements may be utilized. A first end of the torsion spring 36 is received by the first side support 24 and a second end of the torsion spring 36 is received by the first wall mount 14.

The shower seat further includes a center support 38 extending between the first and second rear legs 20, 22 and the first and second front legs 28, 30. The center support 38 is rotatable relative to the first and second rear legs 20, 22 and the first and second front legs 28, 30. The center support 38 is wishbone shaped, although other suitable shapes may be utilized. An apex 40 of the center support 38 is secured to a front leg support 42 extending between the first and second front legs 28, 30, a first end 44 of the center support 38 is secured to the first rear leg 20, and a second end 46 of the center support 38 is secured to the second rear leg 22. The apex 40, the first end 44 of the center support 38, and the second end 46 of the center support 38 are secured to the respective front leg support 42, first rear leg 20, and second rear leg 22 via fasteners 48, such as a nut and bolt, although other suitable securing arrangements may be utilized. The center support 38 is rotatable relative to the first and second rear legs 20, 22 and the first and second front legs 28, 30 to allow movement of the center support 38 as the seat 32 moves from the use position (FIG. 2) to the stowed position (FIG. 8).

Referring again to FIGS. 1-8, the frame 12 further includes a front support 60 extending between the first and second side supports 24, 26. The first and second front legs 28, 30 are connected to and rotatable relative to the front support 60. The first and second front legs 28, 30 each include a sleeve portion 62 that receives the front support 60 and allows the first and second front legs 28, 30 to rotate relative to the front support 60. The center support 38 maintains the lateral position of the first and second front legs 28, 30. The seat 32 is secured to the first and second side supports 24, 26 of the frame 12 via one or more fasteners (not shown), such as a bolt, although other suitable arrangements for securing the seat 32 may be utilized. The first side support 24 and the second side support 26 are secured to the rear support 18 via a shaft 66 extending through and rotatable relative to the rear support 18. The torsion spring 36 is positioned about the shaft 66, although other suitable positions may be utilized. Although the shaft 66 is utilized, other suitable arrangements for rotatably securing the first and second side supports 24, 26 to the rear support 18 may be utilized. The first and second wall mounts include a curved portion 68 and a flange 70, with the flange 70 defining a plurality of openings 72, although other suitable wall mounts may be utilized. Fasteners (not shown), such as screws, may be utilized to secure the wall mounts 14, 16 to a shower wall or other structure. The first and second rear legs 20, 22 and the first and second front legs 28, 30 each include a height-adjustable foot 74. The height-adjustable foot 74 may include a threaded shaft that can be rotated into and out of the legs 20, 22, 28, 30 to change the height that the respective height-adjustable foot 74 extends from the legs 20, 22, 28, 30. The height-adjustable foot 74 may include an elastomeric material to prevent any damage to a shower floor.

As shown in FIGS. 1-7, in one aspect or embodiment, when the seat is in the use position, a bottom surface 76 of the seat 32 is perpendicular to the first and second rear legs 20, 22 and the first and second front legs 28, 30. As shown in FIG. 8, when the seat 32 is in the stowed position, the bottom surface 76 of the seat 32 is parallel to the first and second rear legs 20, 22 and the first and second front legs 28, 30. When the seat 32 is moved from the use position to the stowed position by grasping the seat 32 and lifting upward, the first and second side supports 24, 26 rotate relative to the rear support 18 via the shaft 66, with the rear support 18 and the first and a second wall mounts 14, 16 remaining fixed due to the wall mounts 14, 16 being secured to a wall or other structure. The rear support 18 being fixedly secured to the first and second wall mounts 14, 16 prevents twisting and/or racking of the frame 12, which can cause binding of the components of the frame and increase the amount of force required to move the seat 32 between the use and stowed positions.

As the seat 32 rotates to the stowed position, the first and second front legs 28, 30 rotate relative to the front support 60 such that the front legs 28, 30 remain parallel to the rear legs 20, 22. As noted above, the center support 38 also rotates relative to the first and second rear legs 20, 22 and the first and second front legs 28, 30 to allow the seat to fully rotate to the stowed position. The shower seat 10 includes two torsion springs 36, as discussed above, to bias the seat 32 toward the stowed position, which reduces the amount of force necessary to lift the seat 32 to the stowed position. Although two torsion springs 36 are shown, one or more torsion springs 36 may be provided. The seat 32 is moved from the stowed position to use position by grasping the seat 32 and folding or rotating the seat 32 downward until the first and second front legs 28, 30 contact the shower floor or other structure, with the various components rotating relative to each other in the opposite direction from when the seat 32 moves from the use position to the stowed position, as discussed above.

Figure 9:
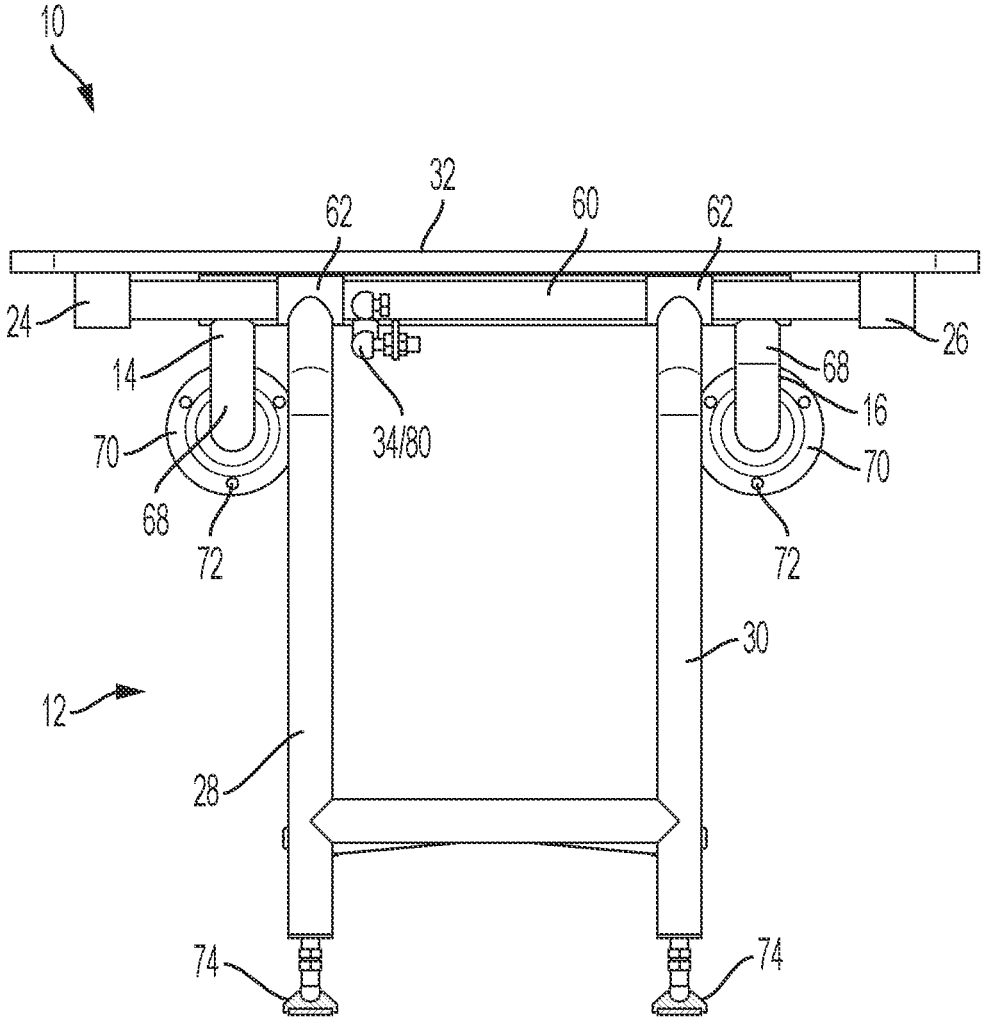
FIG. 9 is a front view of a shower seat according to a further aspect or embodiment of the present application.
Figure 10:
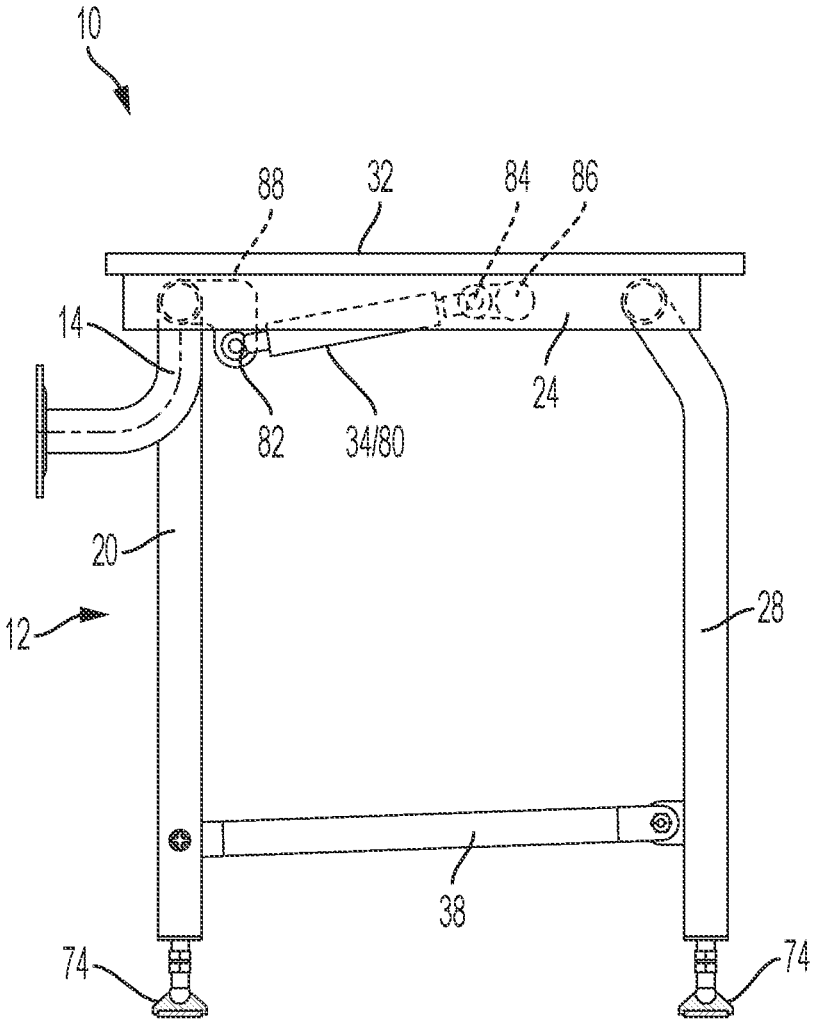
FIG. 10 is a right view of the shower seat of FIG. 9.
Figure 11:
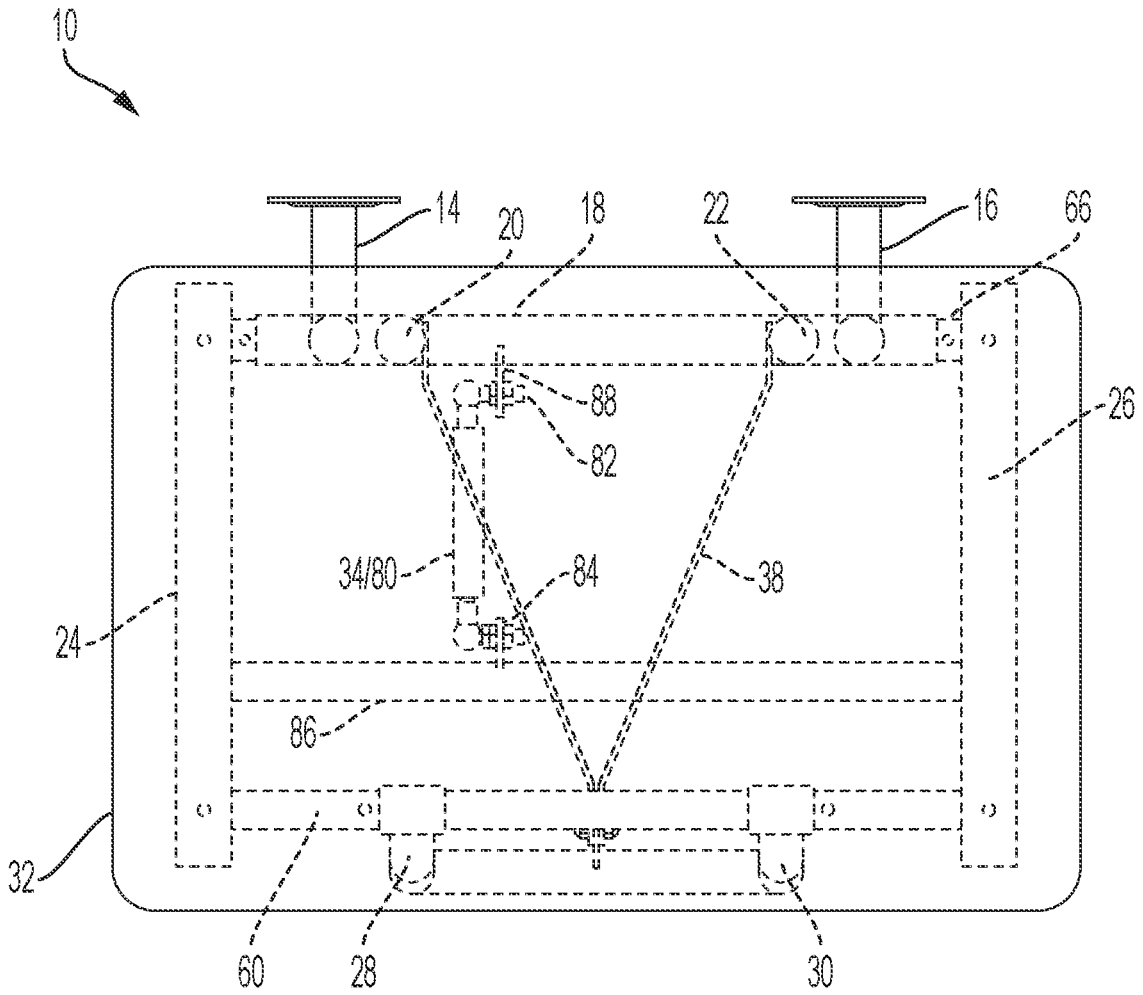
FIG. 11 is a bottom view of the shower seat of FIG. 9.

Referring to FIGS. 9-11, in a further aspect or embodiment, the biasing arrangement 34 is a gas strut 80. A first end 82 of the gas strut 80 is secured to the rear support 18 and a second end 84 of the gas strut 80 is secured to a strut support 86 extending between the first and second side supports 24, 26. More specifically, the first end 82 of the gas strut 80 is secured to a strut bracket 88 secured to the rear support 18. The gas strut 80 is rotatable relative to the rear support 18 and the strut support 86. The gas strut 80 is positioned laterally between the first and second wall mounts 14, 16, although other suitable positioning may be utilized. Although one gas strut 80 is shown, one or more gas struts 80 may be utilized.

Although the invention has been described in detail for the purpose of illustration based on what is currently considered to be the most practical and preferred embodiments, it is to understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any aspect embodiment can be combined with one or more features of any other aspect or embodiment.

The invention claimed is:

1. A shower seat comprising:

a frame comprising a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg, the first and second wall mounts are configured to secure the frame to a wall, the first and second side supports are rotatable relative to the first and second wall mounts and the rear support;

a seat secured to the frame, the frame configured to move the seat between a use position and a stowed position; and a center support extending between the first and second rear legs and the first and second front legs, the center support is rotatable relative to the first and second rear legs and the first and second front legs.

2. The shower seat of claim 1, further comprising a biasing arrangement configured to provide a biasing force to aid in movement of the seat from the use position to the stowed position.

3. The shower seat of claim 2, wherein the biasing arrangement comprises a torsion spring.

4. The shower seat of claim 2, wherein the biasing arrangement comprises a gas strut.

5. The shower seat of claim 1, wherein the center support is wishbone shaped, an apex of the center support is secured to a front leg support extending between the first and second front legs, a first end of the center support is secured to the first rear leg, and a second end of the center support is secured to the second rear leg.

6. The shower seat of claim 1, further comprising a front support extending between the first and second side supports, the first and second front legs are connected to and rotatable relative to the front support.

7. The shower seat of claim 1, wherein the seat is secured to the first and second side supports of the frame.

8. The shower seat of claim 1, wherein the first and second wall mounts each comprise a curved portion and a flange, the flange defining a plurality of openings.

9. The shower seat of claim 1, wherein the first and second rear legs and the first and second front legs each comprise a height-adjustable foot.

10. The shower seat of claim 1, wherein, when the seat is in the use position, a bottom surface of the seat is perpendicular to the first and second rear legs and the first and second front legs, and wherein, when the seat is in the stowed position, the bottom surface of the seat is parallel to the first and second rear legs and the first and second front legs.

11. The shower seat of claim 1, wherein the rear support is formed integrally with at least a portion of the wall mounts and the first and second rear legs.

12. A shower seat comprising:

a frame comprising a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg, the first and second wall mounts are configured to secure the frame to a wall, the first and second side supports are rotatable relative to the first and second wall mounts and the rear support;

a seat secured to the frame, the frame configured to move the seat between a use position and a stowed position; and a biasing arrangement configured to provide a biasing force to aid in movement of the seat from the use position to the stowed position, wherein the biasing arrangement comprises a torsion spring, and wherein a first end of the torsion spring is received by the first side support and a second end of the torsion spring is received by the first wall mount.

13. A shower seat comprising:

a frame comprising a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg, the first and second wall mounts are configured to secure the frame to a wall, the first and second side supports are rotatable relative to the first and second wall mounts and the rear support;

a seat secured to the frame, the frame configured to move the seat between a use position and a stowed position; and a biasing arrangement configured to provide a biasing force to aid in movement of the seat from the use position to the stowed position, wherein the biasing arrangement comprises a gas strut, and wherein a first end of the gas strut is secured to the rear support and a second end of the gas strut is secured to a strut support extending between the first and second side supports.

14. A shower seat comprising:

a frame comprising a first wall mount, a second wall mount spaced from the first wall mount, a rear support secured to and extending between the first and second wall mounts, a first rear leg, a second rear leg spaced from the first rear leg, a first side support, a second side support spaced from the first side support, a first front leg, and a second front leg spaced from the first front leg, the first and second wall mounts are configured to secure the frame to a wall, the first and second side supports are rotatable relative to the first and second wall mounts and the rear support; and a seat secured to the frame, the frame configured to move the seat between a use position and a stowed position, wherein the first side support and the second side support are secured to the rear support via a shaft extending through and rotatable relative to the rear support.

* * * * *